US011866952B2

(12) United States Patent
Eriks

(10) Patent No.: US 11,866,952 B2
(45) Date of Patent: Jan. 9, 2024

(54) UMBRELLA SHAFT SUPPORTING STAND AND METHOD OF INSTALLATION BETWEEN PARALLEL JOISTS

(71) Applicant: Ray Eriks, Crown Point, IN (US)

(72) Inventor: Ray Eriks, Crown Point, IN (US)

( * ) Notice: Subject to any disclaimer, the term of this patent is extended or adjusted under 35 U.S.C. 154(b) by 0 days.

(21) Appl. No.: 17/668,154

(22) Filed: Feb. 9, 2022

(65) Prior Publication Data

US 2023/0250666 A1 Aug. 10, 2023

(51) Int. Cl.
*E04H 12/22* (2006.01)

(52) U.S. Cl.
CPC ..... *E04H 12/2269* (2013.01); *E04H 12/2261* (2013.01)

(58) Field of Classification Search
CPC . A47B 37/04; E04H 12/2269; E04H 17/1447; E04H 17/1417; E04H 12/2261; E04H 12/347; E04B 1/2608; E04B 1/1903; E04B 2001/2415; E04B 2001/2684; E04B 1/003; E04B 2001/2457; F16L 3/00; F16L 5/00
USPC ..... 248/539
See application file for complete search history.

(56) References Cited

U.S. PATENT DOCUMENTS 796,178 A * 8/1905 Beaton ..... F16L 3/00 248/57
833,577 A * 10/1906 Bueto ..... E04H 12/2269 52/298
843,163 A * 2/1907 McCarthy ..... E04B 1/1903 403/292
858,140 A * 6/1907 Beaton ..... F16L 3/00 248/57
1,799,314 A 4/1931 Pfaff
2,098,172 A * 11/1937 Walker ..... E04B 1/2604 403/241
3,130,470 A * 4/1964 Bowden ..... E04G 11/48 211/186
3,215,095 A 11/1965 Keppeler
3,481,571 A * 12/1969 Lauckner ..... F16L 5/00 248/57
3,615,110 A * 10/1971 Fugate ..... F16B 7/00 403/230
4,229,919 A * 10/1980 Hughes ..... A47C 11/00 52/741.1
4,582,287 A 4/1986 DeLeary
(Continued)

*Primary Examiner* — Taylor Morris
(74) *Attorney, Agent, or Firm* — George Pappas Barrett McNagny LLP

(57) ABSTRACT

An umbrella shaft supporting stand adapted to be secured between a pair of parallel joists, wherein the joists each include parallel side surfaces which face and are spaced from each other a distance X. The supporting stand comprises a U-shaped bracket defined by a pair of wings and a central beam extending therebetween. A sleeve is secured to the bracket beam and defines a bore adapted to receive an umbrella shaft receiving tube which receives an umbrella shaft, or which directly receives an umbrella shaft. Each of the wings include parallel side surfaces that face away from and are spaced from each other a distance that matches the distance X. The bracket is secured to the joists by locating the wings between the joists with each of the wing side surfaces located adjacent to and facing a respective joist side surface and fastening the wings to the respective adjacent joist.

18 Claims, 5 Drawing Sheets

(56) References Cited

U.S. PATENT DOCUMENTS 4,930,270 A * 6/1990 Bevacqua ..... E04B 1/0007 248/188.4
5,040,251 A 8/1991 Hanford
5,228,262 A * 7/1993 Meriwether ..... E04G 21/26 52/127.2
5,384,993 A * 1/1995 Phillips ..... E04B 1/34347 52/223.6
5,519,977 A * 5/1996 Callahan ..... E04G 23/0218 52/715
5,546,716 A * 8/1996 Broxterman ..... E04C 3/02 52/693
5,561,950 A * 10/1996 Collins ..... E02D 27/32 248/354.3
5,685,517 A 11/1997 Salibra
5,782,048 A * 7/1998 Ramirez ..... E04H 9/14 52/741.1
6,003,826 A 12/1999 Galloway, III
6,209,147 B1 4/2001 Wheaton
6,328,285 B1 * 12/2001 Wiseman ..... E04H 12/2269 256/67
6,745,529 B2 6/2004 Beltran
6,807,780 B2 * 10/2004 McCahill ..... E04C 3/02 52/220.8
7,040,586 B2 * 5/2006 Kusber ..... H02G 3/30 248/200.1
7,156,357 B1 1/2007 Kocur
7,287,355 B2 * 10/2007 Commins ..... E04B 1/2604 52/573.1
7,377,491 B2 * 5/2008 Fuoco ..... E04F 11/1812 256/65.01
7,575,215 B1 8/2009 Clark et al.
7,627,994 B1 * 12/2009 Demirkan ..... E04H 12/2269 52/165
7,921,616 B2 4/2011 Reyneveld
7,971,411 B2 * 7/2011 Commins ..... E04B 1/2604 52/293.3
8,281,541 B2 * 10/2012 Lucey ..... E04H 9/14 52/715
8,444,105 B2 5/2013 Silvestri
8,485,207 B1 * 7/2013 Boyington ..... E04H 15/06 280/505
8,870,163 B2 * 10/2014 Regan ..... E04F 11/1812 52/298
8,931,749 B2 * 1/2015 Vetesnik ..... F16B 5/0004 248/910
9,428,902 B1 * 8/2016 LoFranco ..... E04B 2/56
9,447,600 B2 9/2016 Walker
9,493,962 B2 * 11/2016 Eddy ..... E04H 12/2261
9,631,768 B1 * 4/2017 Cote ..... E04H 12/2261
10,187,793 B2 5/2019 Anslem et al.
10,323,788 B2 6/2019 Budleski
10,519,657 B1 * 12/2019 Callahan ..... E04C 3/145
11,572,696 B1 * 2/2023 Kowalewski ..... E04F 11/1817
2005/0102928 A1 * 5/2005 Oidtman ..... E01F 13/024 52/169.9
2007/0107170 A1 * 5/2007 Killip ..... A47B 37/04 24/346
2007/0108363 A1 * 5/2007 Metheny ..... E04F 10/04 248/539
2008/0181729 A1 * 7/2008 Van Horn ..... E02D 5/28 405/231
2009/0045301 A1 * 2/2009 Collins ..... F16L 3/245 248/65
2009/0314910 A1 * 12/2009 Jeanveau ..... E04H 12/2261 248/231.71
2012/0132779 A1 5/2012 Johnson et al.
2014/0017423 A1 * 1/2014 Veazey ..... E04H 12/2269 428/34.1
2015/0082735 A1 * 3/2015 Truckner ..... E04H 12/2253 52/655.1
2018/0306350 A1 * 10/2018 Goubault ..... F16L 5/02
2021/0088180 A1 * 3/2021 Thompson ..... F16B 2/065
2021/0177165 A1 * 6/2021 Tarpey ..... A47G 25/12
2022/0090385 A1 * 3/2022 Leary ..... E04F 11/1817

* cited by examiner

UMBRELLA SHAFT SUPPORTING STAND AND METHOD OF INSTALLATION BETWEEN PARALLEL JOISTS

BACKGROUND OF THE INVENTION

1. Field of the Invention

The present invention relates to devices which are used to support umbrellas. More particularly, the present invention relates to devices which can be secured to parallel joists for thereby providing a stable mounted support stand for an umbrella shaft.

2. Background

Users enjoying leisure activities on outdoor flooring structures, such as decks and docks, often seek shade in order to avoid overheating and sunburn. Accordingly, it is well known to provide a sun shading umbrella upon or secured to such structures. Typically, the umbrellas have a collapsible fabric canopy attached to a central shaft. The umbrella central shaft is secured to a mounting structure which thereby supports the umbrella in the desired location. Some umbrella mounting structures take the form of moveable, weighted stands which rest on top of the flooring structure, and which can be moved about the flooring structure or removed as desired. However, these moveable stands can be undesirably displaced by impacts against the stand or the umbrella or by forces generated by wind acting on the canopy of the umbrella. Additionally, the weighted stands are difficult to move when it is desired to remove them off of the flooring structure. As such, a variety of directly mounted stands have been designed to mount the umbrella directly to the flooring structure.

The directly mounted stands are often mounted to flooring structures, such as decks and docks, which are typically constructed with horizontal joists and flooring planks laid across the joists. The joists are supported in a known and customary manner parallel to one another. Flooring planks are laid across and fastened to the joists in a direction generally perpendicular to the joists for thereby forming a deck/dock floor. Often, the flooring planks are spaced to leave a small gap between boards to aid in drainage and prevent accumulation of water.

Examples of prior directly mounted umbrella stands are shown and described in Budleski, U.S. Pat. No. 10,323,788; Kocur, U.S. Pat. No. 7,156,357; Johnson et al., US 2012/0132779; Walker, U.S. Pat. No. 9,447,600; Clark et al., U.S. Pat. No. 7,575,215; and DeLeary, U.S. Pat. No. 4,582,287. These prior art directly mounted stands typically attach to the side of the joists or are adapted to be inserted between flooring planks and attach/hook on to one or more joists. They sufficiently function to support the umbrella shaft as needed or desired. However, they can be difficult to mount to the flooring structure, sometimes comprise parts that remain exposed above the flooring structure when the umbrella is not supported thereon and/or are not sufficiently sturdy and durable to withstand severe impacts and wind forces which the umbrella may experience. Therefore, a need exists for an umbrella stand which can easily be attached to a flooring structure, which is not exposed above the flooring structure when not supporting an umbrella, and which is sturdy and durable so as to withstand impacts and/or wind forces which the umbrella may experience.

SUMMARY OF THE INVENTION

In the present invention, an umbrella stand is adapted to secure an umbrella to a flooring structure comprising parallel joists, such as an indoor or outdoor deck. The deck is typically constructed with horizontal joists and flooring planks laid atop/across the joists. The umbrella typically has a collapsible fabric canopy attached to a central umbrella shaft. A retaining pin hole can be provided through the umbrella shaft for accepting a retaining pin. The umbrella stand is adapted to be secured to the deck between a pair of adjacent parallel joists for supporting/securing the umbrella shaft and, hence, the umbrella to and upon the deck.

In the present exemplary embodiment, the umbrella stand includes a U-shaped bracket, a sleeve, and an umbrella shaft receiving tube, all of which are preferably made of metal. The sleeve is secured to the bracket and is configured to accept one end of the umbrella shaft receiving tube. The umbrella shaft receiving tube is configured to be received in the sleeve and to accept the terminal bottom end of the umbrella shaft. It effectively elongates the umbrella shaft and, as used herein, the "umbrella shaft receiving tube" and the "umbrella shaft" are considered to be equivalent and interchangeable components adapted to be received in the sleeve. Hence, as used herein, the "sleeve umbrella shaft receiving bore" is intended to and means a bore adapted to receive any of an umbrella shaft receiving tube or an umbrella shaft itself.

The U-shaped bracket includes a horizontal beam, a right mounting wing, and a left mounting wing. After installation, the beam is positioned generally parallel to the flooring planks whereby the top surface of the beam can be placed adjacent to, or against/abutting, the bottom surface of the flooring planks, or positioned such that the top surface of the beam is aligned with the top surface of the flooring planks. The right and left mounting wings extend generally parallel to one another and extend generally perpendicular from the respective right and left edges of the beam in a direction opposite the top surface of the beam, for thereby forming a U-shape. A sleeve bore is provided extending through the beam and is preferably configured to snugly accept the sleeve. The U-shaped bracket is sized such that the distance between the exterior surfaces of the wings matches the distance between side surfaces of a pair of adjacent joists which side surfaces are parallel and face each other.

In construction of the umbrella stand, the sleeve is inserted through the beam sleeve bore and is positioned generally perpendicular to the beam. In one embodiment, the sleeve is inserted through the sleeve bore until the terminal end of the sleeve extends a distance equal to the thickness of the flooring planks past the top surface of the beam, so that the top terminal end of the sleeve is flush with the top surface of the flooring planks when the umbrella stand is secured to the deck. In another embodiment, the sleeve is inserted through the sleeve bore until the terminal end of the sleeve is flush with the beam top surface so that, when the umbrella stand is secured to the deck, the top terminal end of the sleeve and the top surface of the beam are flush with the top surface of the flooring planks. The sleeve is then secured to the bracket with securing means such as, for example, by welding.

In the present exemplary embodiments, the sleeve further includes sleeve pin locating bores extending transversely through the wall of the sleeve near the sleeve terminal end opposite the beam. A sleeve locating pin is configured to be frictionally inserted/secured and/or welded within the sleeve locating bores.

As mentioned hereinabove, the umbrella shaft receiving tube is configured to be received in the sleeve and to accept the terminal bottom end of the umbrella shaft. Preferably, the umbrella shaft receiving tube includes several locating slots extending into the umbrella receiving tube terminal end and configured to, when the umbrella receiving tube is inserted into the sleeve, engage the sleeve locating pin for thereby preventing rotation of the umbrella receiving tube about its longitudinal axis. In the present exemplary embodiments, the umbrella shaft receiving tube includes four regularly spaced locating slots for thereby allowing a user to lock the umbrella shaft receiving tube into one of four rotational positions disposed at 90° intervals about the longitudinal axis of the umbrella shaft receiving tube.

For locating the umbrella shaft at a desired vertical position, preferably, the umbrella shaft receiving tube includes umbrella shaft locating bores extending transversely therethrough near a longitudinal midpoint thereof. An umbrella shaft locating pin is frictionally inserted/secured and/or welded within the umbrella receiving tube bore. When the umbrella shaft is inserted into the umbrella shaft receiving tube, the bottom terminal end thereof abuts the umbrella shaft locating pin thereby locating the umbrella shaft and, hence, the umbrella in the desired vertical position.

For preventing rotation of the umbrella about the umbrella shaft receiving tube and preventing undesired withdrawal of the umbrella shaft from the umbrella receiving tube, such as by winds pushing the umbrella upwardly, the umbrella shaft receiving tube includes umbrella shaft retaining bores similarly extending transversely through the umbrella shaft receiving tube. The shaft retaining bores are located vertically above the umbrella shaft locating bores and, preferably, near the umbrella receiving tube top terminal end opposite the sleeve. A retaining pin is configured to be inserted through the retaining bores and a transverse hole in the umbrella shaft for thereby securing the umbrella shaft within the umbrella shaft receiving tube. Preferably, the retaining pin is selectively detachably attachable within the shaft retaining bores.

In the present exemplary embodiments, a plurality of regularly spaced fastener holes are provided extending through the right and left mounting wings. The fastener holes are adapted to receive fasteners therethrough so as to secure the right and left mounting wings to the joists. The fasteners can be, but are not limited to, fastening means such as screws, nails, and bolts. In the present exemplary embodiments, the fasteners are wood screws configured to extend through a fastener hole and be rotatably driven into wooden joists until the head thereof is snug against one of the wings.

In the present exemplary embodiments, several stiffening ribs are provided between the sleeve and the horizontal beam of the U-shaped bracket to strengthen, support and maintain the sleeve in a position generally perpendicular to the beam. Preferably, the stiffening ribs have a triangular shape, are spaced at regular intervals about the perimeter of the sleeve and are welded to the sleeve and the sleeve.

Preferably, the U-shaped bracket is sized to fit between common spacings of wood joists. As such, the outside surfaces of the right and left wings of the bracket can preferably be spaced 10.5", 14.5", and 22.5" apart so as to fit respective 12", 16", and 24" on-center joist spacings of 1.5" thick wood joists which are common in deck construction. The height of right and left mounting wings measured from the beam can also be sized to match the dimensions of the joists used for the deck. For example, 2"×4", 2"×6", 2"×8", 2"×10", and 2"×12" planks are often used as joists depending on the load bearing requirements of the deck. As such, the height of right and left mounting wings can be sized to correspond to the width of the plank used for the joists, e.g. 3.5", 5.5", 7.5", 9.5" and 11.5".

Preferably, the umbrella stand is made by bending or otherwise molding, forming or shaping a unitary flat sheet of metal to form the U-shaped bracket. The sleeve and the umbrella receiving tubes can be cut from common metal lengths of pipe/tubing The umbrella stand is installed by locating it in a desired position between a pair of parallel joists with the right and left mounting wings against/abutting the joists. Fasteners are inserted through the fastener holes and are rotatably driven into the joists for thereby securing the wings to their adjacent joist, and thereby securing umbrella stand to the deck. Preferably, the umbrella stand is secured to the joists before the flooring planks are laid atop/across the joists and an umbrella shaft receiving hole is drilled through the flooring planks, as they are secured atop the joists, wherein the umbrella shaft receiving hole is aligned with the sleeve and sized to receive the umbrella shaft receiving tube. Alternatively, the umbrella stand can be secured to the joists after the flooring planks are attached to the joists by selectively drilling the umbrella shaft receiving hole through the flooring planks and aligning the umbrella stand sleeve with the hole before securing the wings to the joists.

After installation, the umbrella stand is used by inserting the umbrella shaft receiving tube into the sleeve until its bottom terminal end rests atop/abuts the sleeve locating pin. The umbrella shaft is then inserted into the umbrella shaft receiving tube. The umbrella shaft is inserted until the umbrella shaft terminal end rests atop/abuts the umbrella shaft locating pin and the umbrella is located in the desired position. The retaining pin is then inserted through the retaining bores for thereby securing the umbrella shaft to the umbrella shaft receiving tube and the deck. Alternatively, the umbrella stand can be used by removing the umbrella shaft receiving tube and inserting the umbrella shaft directly into the sleeve until the umbrella shaft terminal end rests atop/abuts the sleeve locating pin and the umbrella is located in the desired position.

In one form thereof, the present invention is directed to an umbrella shaft supporting stand adapted to be secured between a pair of parallel joists, wherein the joists each include parallel side surfaces which face and are spaced from each other a distance X. The umbrella shaft supporting stand includes a bracket comprising a pair of wings and a central beam extending therebetween, and a sleeve secured to the bracket and defining an umbrella shaft receiving bore. Each of the wings include parallel side surfaces that face away from and are spaced from each other a distance which matches the distance X. The bracket is secured to the joists by locating the wings between the joists with each of the wing side surfaces located adjacent to and facing a respective joist side surface and fastening the wings to the respective adjacent joist.

Preferably, the sleeve is secured to the central beam. A plurality of strengthening gussets can be provided between the sleeve and the central beam. The central beam may include an umbrella shaft receiving hole which is aligned with the sleeve umbrella shaft receiving bore, and the sleeve may extend through the central beam umbrella shaft receiving hole. A plurality of fastener holes are preferably provided extending through the wings for receiving a fastener therethrough and for securement to the joists. An elongate extension or tube may be provided adapted to be received in the sleeve umbrella shaft receiving bore and comprising a second umbrella shaft receiving bore, whereby the umbrella shaft may effectively be elongated.

More preferably, a stop pin is provided in the sleeve umbrella shaft receiving bore and a terminal end of the elongate extension comprises an indent, wherein the indent couples with the stop pin when the elongate extension terminal end is received in the sleeve umbrella shaft receiving bore, whereby the elongate extension is supported and prevented from rotating. Also preferably, the central beam extends between the wings from terminal ends of each of the wings, whereby the bracket is U-shaped. The U-shaped bracket can be integrally formed by bending a flat metal section.

In another form thereof, the present invention is directed to a method of installing an umbrella stand between a pair of parallel joists, wherein the joists each include parallel side surfaces which face and are spaced from each other a distance X. The umbrella stand includes a bracket comprising a pair of wings and a central beam extending therebetween, and a sleeve secured to the bracket and defining an umbrella shaft receiving bore. Each of the wings include parallel side surfaces that face away from and are spaced from each other a distance which matches the distance X. The method includes the steps of: locating the bracket wings between the joists with each of the wing side surfaces located adjacent to and facing a respective joist side surface; and, fastening the wings to the respective adjacent joist.

Preferably, the bracket wings comprise a plurality fastener holes and, during the step of fastening, one or more of nails, screws and bolts, are inserted through the fastener holes and into the joist. Also preferably, the bracket central beam extends between the wings from terminal ends of each of the wings, whereby the bracket is U-shaped, and wherein, during the step of locating, further comprising the step of aligning the central beam with top surfaces of the joists. Most preferably, the bracket sleeve includes a terminal protuberance extending a distance from the central beam, and the method further comprises the step of extending the terminal protuberance at least partially through a floor supported on the joists.

BRIEF DESCRIPTION OF THE DRAWINGS

The above mentioned and other features of this invention, and the manner of attaining them, will become more apparent and the invention itself will be better understood by reference to the following description of the embodiments of the invention taken in conjunction with the accompanying drawings, wherein.

Figure 1:
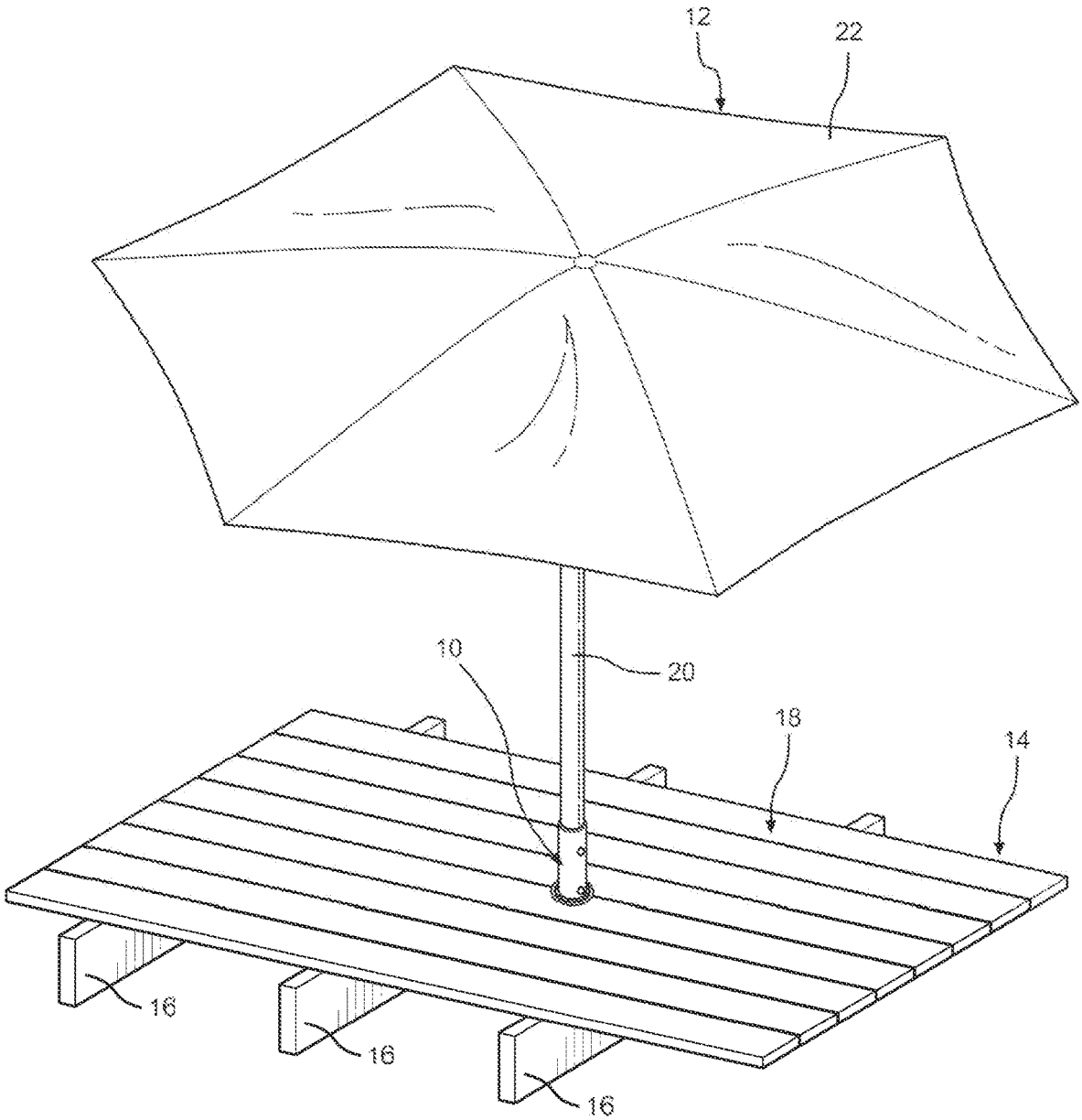
FIG. 1 is a perspective view of an umbrella secured to a deck with an umbrella stand in accordance with the principles of the present invention.
Figure 2:
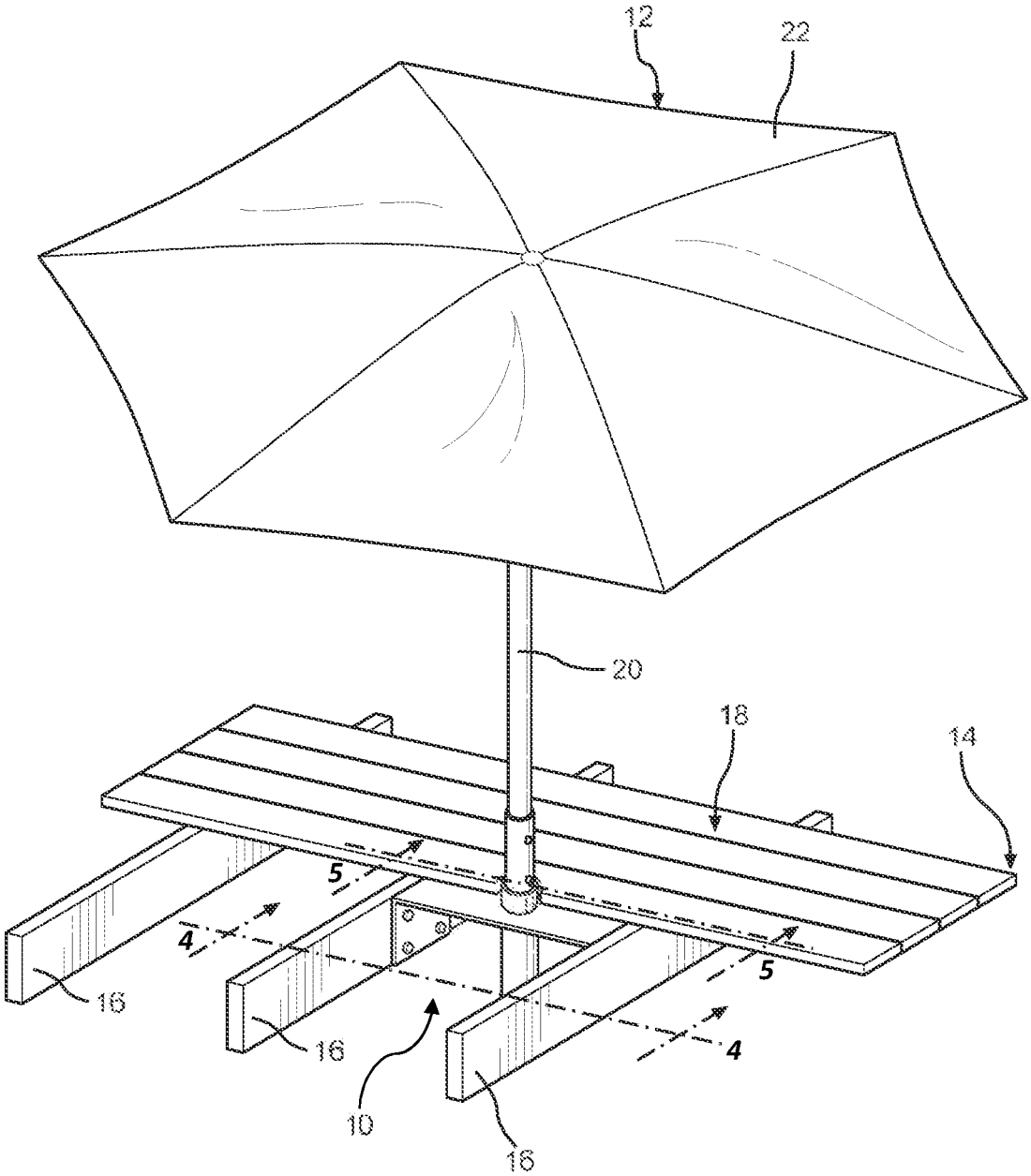
FIG. 2 is another perspective view of the umbrella and deck shown in FIG. 1, but with part of the deck floor planking removed and showing the umbrella stand constructed in accordance with the principles of the present invention and secured between a pair of parallel joists.

Corresponding reference characters indicate corresponding parts throughout several views. Although the exemplification set out herein illustrate preferred embodiments of the invention, the embodiments disclosed below are not intended to be exhaustive or to be construed as limiting the scope of the invention to the precise form disclosed.

DETAILED DESCRIPTION OF THE PREFERRED EMBODIMENTS

An umbrella stand constructed in accordance with the principles of the present invention is shown and designated in the drawings by the numeral 10. The umbrella stand 10 is adapted to secure an umbrella 12 to a deck 14. The deck 14 is constructed with horizontal joists 16 and flooring planks 18 laid atop/across the joists 16. The umbrella stand 10 is adapted to be secured to the deck 14 between a pair of parallel adjacent joists 16 to thereby support/secure the umbrella 12 to the deck 14.

Preferably, the umbrella stand 10 is secured to the joists 16 before the flooring planks 18 are laid atop/across the joists 16 and a hole is provided extending through the flooring planks 18 which is aligned with the sleeve 26 and is sized to receive the umbrella receiving tube 28 for thereby allowing the umbrella receiving tube 28 to be inserted into the sleeve 26. Alternatively, the umbrella stand 10 can be secured to the joists 16 after the flooring planks 18 are attached by selectively cutting a hole through the flooring planks 18 and aligning the sleeve 26 with the hole before securing the umbrella stand 10 to the joists 16.

In the preferred embodiment, the umbrella 12 includes an umbrella shaft 20 and a canopy 22. The umbrella shaft 20 further includes an umbrella shaft terminal end 21 and an umbrella retaining hole 23 provided through the umbrella shaft 20 for thereby accepting a retaining pin 66.

In the present exemplary embodiment, the umbrella stand 10 includes a U-shaped bracket 24, a sleeve 26, and an umbrella receiving tube 28 which are made of metal such as carbon steel, aluminum and stainless steel. The sleeve 26 is secured to the bracket 24 and configured to accept one end of the umbrella receiving tube 28. The umbrella receiving tube 28 is configured to accept the umbrella shaft terminal end 21.

The U-shaped bracket 24 of the umbrella stand 10 includes a beam 30 defined between a top surface 32 and a bottom surface 34, a right mounting wing 36 defined between a right exterior surface 38 and a right interior surface 40, and a left mounting wing 40 defined between a left exterior surface 44 and a left interior surface 46. When the bracket 24 is secured to the joists 16, the beam 30 is positioned generally parallel to the flooring planks 18 with its top surface 32 placed adjacent to, or against/abutting, the bottom surface of flooring planks 18, and positioned such that the top surface 32 is aligned with the top surface of the joists 16. The right and left mounting wings 36, 42 extend generally parallel to one another and extend generally perpendicular from the respective right and left edges of the beam 30 in a direction opposite the top surface 32 for thereby forming a U-shape. A sleeve bore 48 is provided extending through the beam 30 from the top surface 32 to the bottom surface 34 and is configured to snugly accept the sleeve 26. The U-shaped bracket 24 is sized such that the distance between the right and left exterior surfaces 38, 44 matches the distance between a pair of adjacent joists 16. A used herein, "matches" means the same or slightly smaller so that bracket 24 can slidingly be received between a pair of adjacent joists 16 with the wing right and left surfaces 38, 44 facing the adjacent joists 16.

The sleeve 26 comprises an interior cylindrical bore extending between sleeve terminal ends 50*a*, 50*b*. The sleeve 26 cylindrical bore is configured to accept the umbrella shaft receiving tube 28. For securing the sleeve 26 to the bracket 24, the sleeve 26 is inserted through the sleeve bore 48, positioned generally perpendicular to the beam 30 and welded thereto. In the preferred embodiment, the sleeve 26 is inserted through the sleeve bore 48 until the sleeve terminal end 50*a* extends a distance equal to the thickness of the flooring planks 18 past the top surface 32 so that, after the bracket 24 is secured between a pair of adjacent joists 16 and the deck flooring planks are installed thereabove, the sleeve terminal end 50*a* is flush with the top surface of the flooring planks 18.

In the present exemplary embodiment, the sleeve 26 further includes aligned sleeve locating bores 52 extending transversely through the sleeve 26 near the sleeve terminal end 50*b*. A sleeve locating pin 54 is configured to be frictionally inserted/secured and/or welded within the sleeve locating bores 52. The sleeve locating pin 54 is configured to engage the umbrella shaft receiving tube locating slots 56 for thereby preventing rotation of the umbrella shaft receiving tube 28 about its longitudinal axis.

The umbrella shaft receiving tube 28 defines an interior cylindrical bore between umbrella shaft receiving tube terminal ends 58*a*, 58*b*. The umbrella shaft receiving tube cylindrical bore is configured to accept the umbrella shaft 20. The umbrella shaft receiving tube 28 can include several umbrella receiving tube locating slots 56 extending into the umbrella receiving tube terminal end 58*b* and configured to accept the sleeve locating pin 54. In the present exemplary embodiment, the umbrella receiving tube 28 includes four regularly spaced umbrella receiving tube locating slots 56 for thereby allowing a user to lock the umbrella shaft receiving tube 28 into one of four rotational positions disposed at 90° intervals about the longitudinal axis of the umbrella shaft receiving tube 28.

The umbrella shaft receiving tube 28 includes aligned umbrella shaft receiving tube bores 60 extending transversely therethrough near a midpoint between its terminal ends 58*a*, 58*b*. An umbrella shaft locating pin 62 is configured to be frictionally inserted/secured and/or welded within the umbrella receiving tube bores 60. When the umbrella shaft 20 is received in the umbrella shaft receiving tube 28 bore through the upper terminal end 58*a* thereof, the umbrella terminal end 21 rests/abuts the umbrella shaft locating pin 62 for thereby locating the umbrella 12 in a desired vertical position.

Preferably, the umbrella receiving tube 28 further includes aligned retaining bores 64 extending transversely therethrough near the umbrella shaft receiving tube terminal end 58*a* and vertically above the umbrella shaft locating pin 62. A retaining pin 66 is configured to be inserted through the retaining bores 64 and a hole 23 in the umbrella shaft 20 for thereby securing the umbrella 12 within the umbrella shaft receiving tube 28. The retaining pin 66 can be a coupler latch safety pin.

Figure 3:
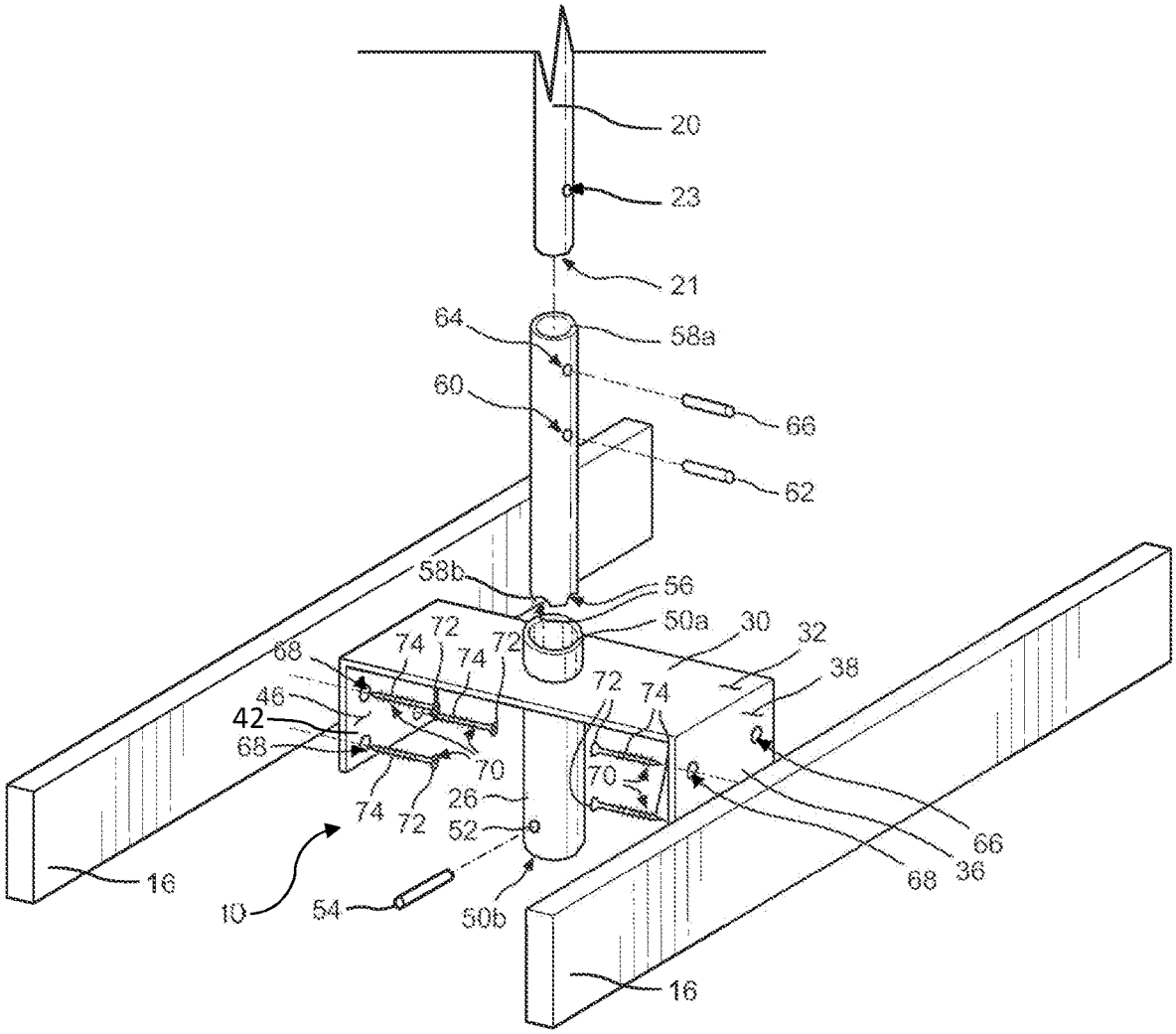
FIG. 3 is an exploded perspective view of the umbrella stand shown in FIG. 2, showing the umbrella stand U-shaped bracket being secured with fastening screws to adjacent joists, the umbrella shaft receiving tube being received in the bracket sleeve, and the umbrella shaft being received in the receiving tube'
Figure 4:
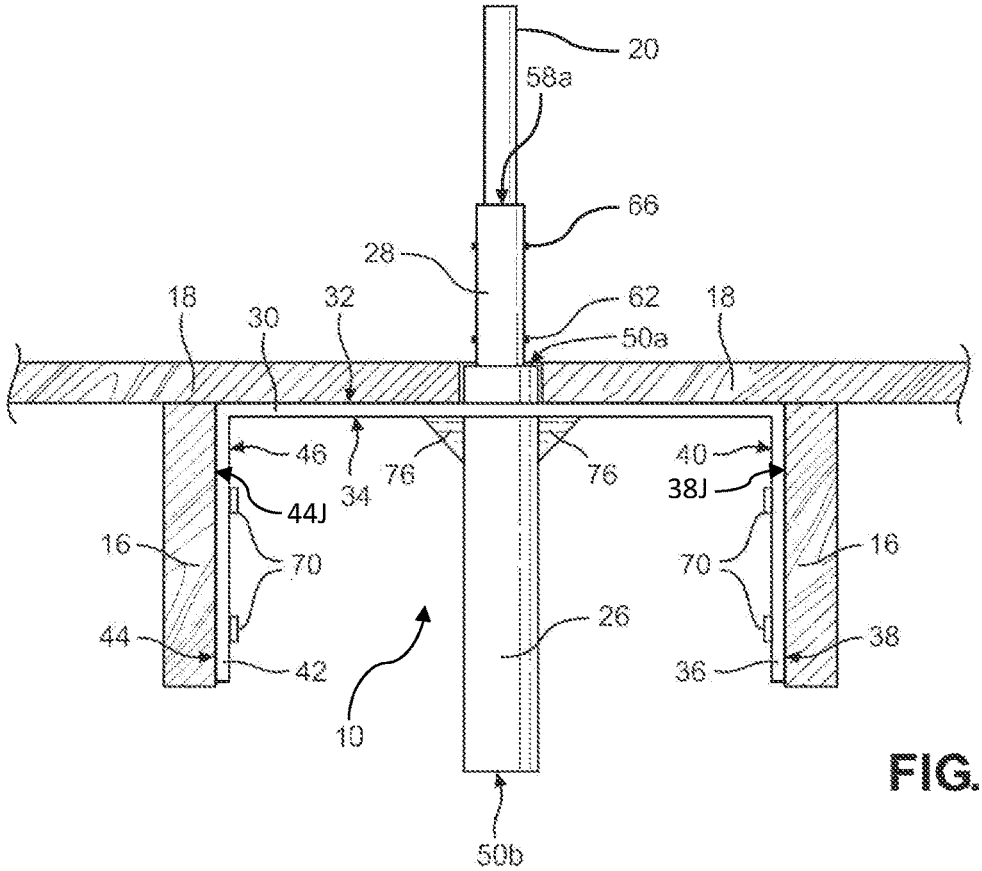
FIG. 4 is a cross-section view of the deck joists and deck floor planking taken along line 4-4 of FIG. 2 and showing the umbrella stand secured to adjacent joists.
Figure 5:
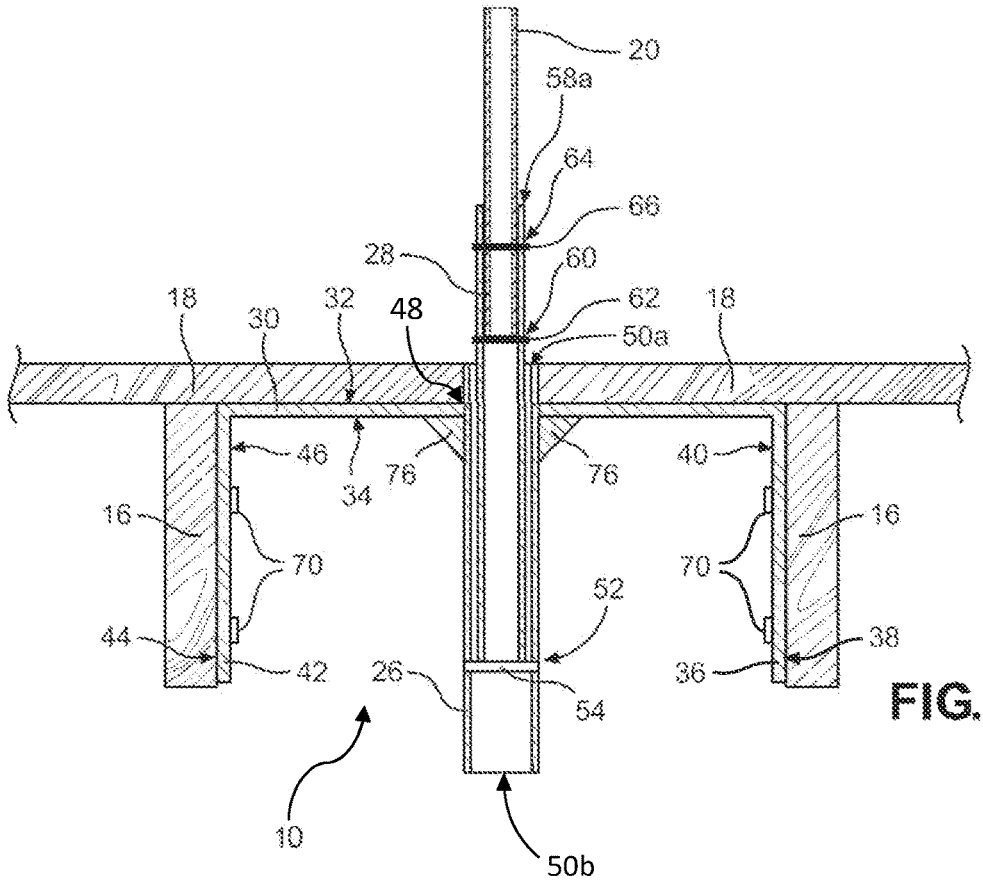
FIG. 5 is a cross-section view similar to FIG. 4 but taken along line 5-5 of FIG. 2.
Figure 6:
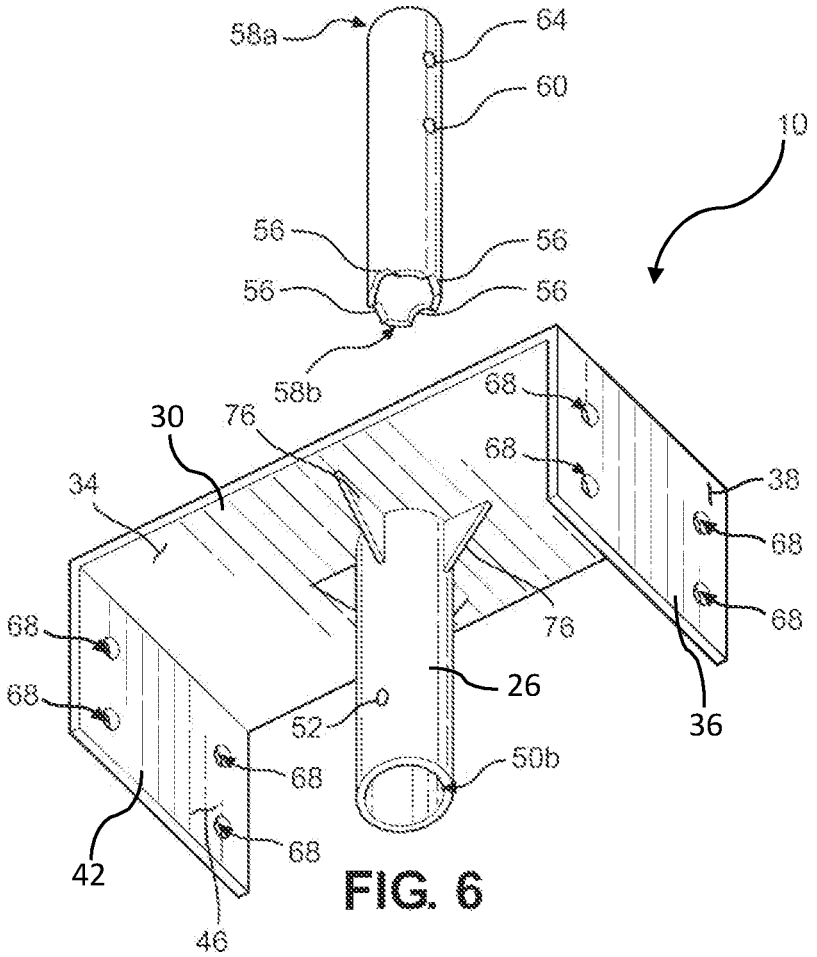
FIG. 6 is an exploded perspective view of the umbrella stand and umbrella shaft receiving tube shown in FIG. 2; and, FIG. 7 is another perspective view of the umbrella stand shown in FIG. 6.
Figure 7:
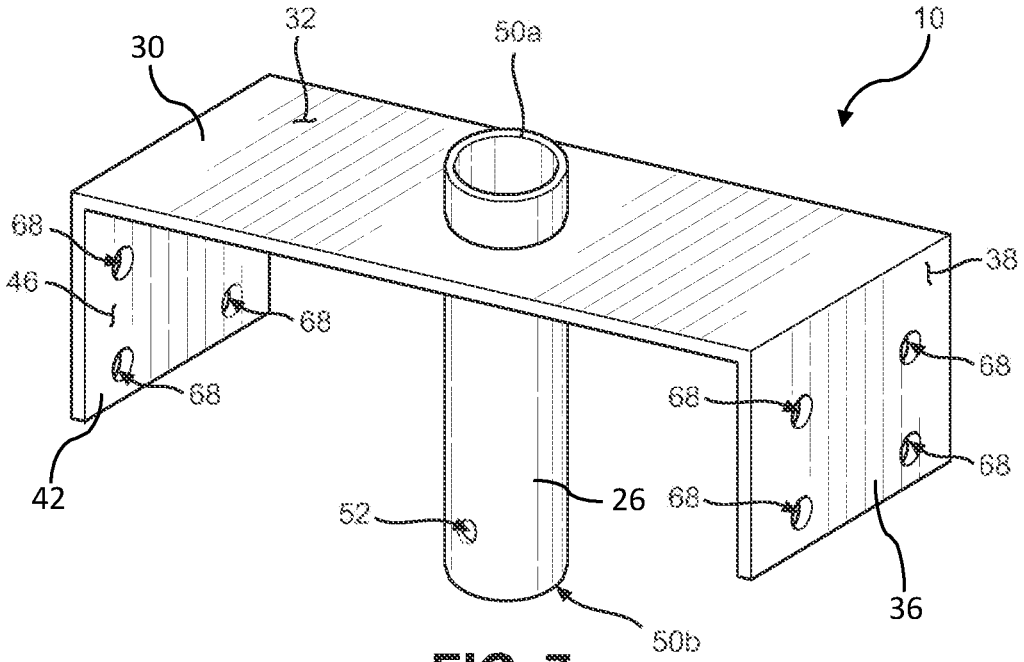

In the present exemplary embodiment, a plurality of regularly spaced fastener holes 68 are provided extending through the right and left mounting wings 36, 42. The fastener holes 68 are adapted to receive fasteners 70 therethrough. The fasteners 70 secure the right and left mounting wings 36, 42 to joists 16. The fasteners 70 can be, but are not limited to, fastening means such as wood screws, nails, and bolts. The wood screws 70 shown in FIG. 3 can comprise integrally formed heads 72 and threaded shanks 74. The threaded shanks 74 are configured to be received through a fastener hole 68 and be rotatably driven into a joist 16 until the heads 72 are snug against one of the right or left interior surfaces 40, 46 for thereby securing the umbrella stand 10 to the joists 16.

Several stiffening ribs 76 are provided between the sleeve 26 and the beam 30 to strengthen and support the sleeve 26 in a position generally perpendicular to the beam 30. Preferably, the stiffening ribs 76 have a triangular shape, are spaced at regular intervals about the perimeter of the sleeve 26 and are welded to the sleeve 26 and the bracket beam 30.

As shown in the drawings, the umbrella stand bracket 24 is sized to fit between adjacent parallel wood joists 16, namely, between the adjacent parallel joist surfaces 38J and 44J which face each other. The right and left exterior surfaces 38, 44 of the U-shaped bracket 24 are correspondingly spaced apart a distance that matches the distance between the joist surfaces 38J, 44J. The U-shaped bracket 24 is preferably sized to fit between common spacings of joists 16. As such, the right and left exterior surfaces 38, 44 of the bracket mounting wings 36, 42 are preferably spaced 10.5", 14.5", or 22.5" apart so as to fit respective 12", 16", and 24" on-center joist spacings using 1.5" thick joists which are common in deck and other wood structures construction.

The height of right and left mounting wings 36, 42 can also be sized to match the dimensions of the joists used for the deck. For example, 2"×4", 2"×6", 2"×8", 2"×10", and 2"×12" planks are often used as joists 16 depending on the load bearing requirements of the deck 14. As such, height of the right and left mounting wings 36, 42 can be sized to correspond to the width of the plank used for the joists, e.g. 3.5", 5.5", 7.5", 9.5" and 11.5". Preferably, the umbrella stand 10 is made by bending or otherwise molding, forming or shaping a unitary flat sheet of metal, to form the U-shaped bracket 24. The sleeve 26 and the umbrella receiving tube 28 can be made by cutting from lengths of pipe/tubing. The sleeve locating pin 54 and the umbrella shaft locating pin 62 can be cut from standard size lengths of metal rod The umbrella stand 10 is installed by locating it in a desired position between a pair of parallel joists 16 with the right and left mounting wings exterior surfaces 38, 44 facing the joists respective surfaces 38J, 44J. Fasteners 70 are inserted through the fastener holes 68 and are rotatably driven into the joists for thereby securing the wings 36, 42 to their adjacent joist, and thereby securing umbrella stand 10 to the deck 14. Preferably, the umbrella stand 10 is secured to the joists 16 before the flooring planks 18 are laid atop/across the joists 16 and an umbrella shaft receiving hole is drilled through the flooring planks 18, as they are secured atop the joists 16, wherein the umbrella shaft receiving hole is aligned with the sleeve 26 and sized to receive the umbrella shaft receiving tube 28. Alternatively, the umbrella stand 10 can be secured to the joists 16 after the flooring planks 18 are attached to the joists 16 by selectively drilling the umbrella shaft receiving hole through the flooring planks 18 and aligning the umbrella stand sleeve 26 with the hole before securing the wings 36, 42 to the joists 16.

After installation, the umbrella stand 10 is used by inserting the umbrella shaft receiving tube 28 into the sleeve 26 until its bottom terminal end rests atop/abuts the sleeve locating pin 54. The umbrella shaft 20 is then inserted into the umbrella shaft receiving tube 28. The umbrella shaft 20 is inserted until the umbrella shaft terminal end 21 rests atop/abuts the umbrella shaft locating pin 62 and the umbrella is located in the desired vertical position. The retaining pin 66 is then inserted through the retaining bores 64 and the umbrella shaft hole 23 for thereby securing the umbrella shaft 20 to the umbrella shaft receiving tube 28 and the deck 14. Alternatively, the umbrella stand 10 can be used by removing the umbrella shaft receiving tube 28 and inserting the umbrella shaft 20 directly into the sleeve 26 until the umbrella shaft terminal end 21 rests atop/abuts the sleeve locating pin 54 and the umbrella is located in the desired vertical position.

While this invention has been described as having an exemplary design, the present invention may be further modified within the spirit and scope of this disclosure. This application is therefore intended to cover any variations, uses, or adaptations of the invention using its general principles.

What is claimed is:

1. An umbrella shaft supporting stand adapted to be secured between a pair of parallel joists of a flooring structure, wherein the joists each include parallel side surfaces which face and are spaced from each other a distance X, the umbrella shaft supporting stand comprising:

a bracket comprising a pair of wings and a central beam extending therebetween;

a sleeve secured to the bracket and defining an umbrella shaft receiving bore;

wherein the central beam includes an umbrella shaft receiving hole aligned with the sleeve umbrella shaft receiving bore;

wherein each of the wings include parallel side surfaces that face away from and are spaced from each other a distance which matches the distance X and the bracket is secured to the joists by locating the wings between the joists with each of the wing side surfaces located adjacent to and facing a respective joist side surface and fastening the wings to the respective adjacent joist.

2. The umbrella shaft supporting stand of claim 1, wherein the sleeve is secured to the central beam.

3. The umbrella shaft supporting stand of claim 1, further comprising a plurality of strengthening gussets between the sleeve and the central beam.

4. The umbrella shaft supporting stand of claim 2, further comprising a plurality of strengthening gussets between the sleeve and the central beam.

5. The umbrella shaft supporting stand of claim 2, wherein the sleeve extends through the central beam umbrella shaft receiving hole.

6. The umbrella shaft supporting stand of claim 5, further comprising: a plurality of strengthening gussets between the sleeve and the central beam; and, a plurality of fastener holes extending through the wings for receiving a fastener therethrough and securement to the joists.

7. The umbrella shaft supporting stand of claim 1, further comprising an elongate extension adapted to be received in the sleeve umbrella shaft receiving bore and comprising a second umbrella shaft receiving bore.

8. The umbrella shaft supporting stand of claim 7, wherein a stop pin is provided in the sleeve umbrella shaft receiving bore and a terminal end of the elongate extension comprises an indent, wherein the indent couples with the stop pin when the elongate extension terminal end is received in the sleeve umbrella shaft receiving bore, whereby the elongate extension is supported and prevented from rotating.

9. The umbrella shaft supporting stand of claim 1, wherein the central beam extends between the wings from terminal ends of each of the wings, whereby the bracket is U-shaped.

10. The umbrella shaft supporting stand of claim 9, wherein the U-shaped bracket is integrally formed by bending a flat metal section.

11. The umbrella shaft supporting stand of claim 1, further comprising a plurality of fastener holes extending through the wings for receiving a fastener therethrough and securement to the joists.

12. A method of installing an umbrella stand between a pair of parallel joists of a flooring structure, wherein the joists each include parallel side surfaces which face and are spaced from each other a distance X, and wherein the umbrella stand comprises:

a bracket comprising a pair of wings and a central beam extending therebetween; a sleeve secured to the bracket and defining an umbrella shaft receiving bore; and, wherein each of the wings include parallel side surfaces that face away from and are spaced from each other a distance which matches the distance X;

the method comprising the steps of:

locating the bracket wings between the joists with each of the wing side surfaces located adjacent to and facing a respective joist side surface;

aligning the central beam with top surfaces of the joists; and, fastening the wings to the respective adjacent joist.

13. The method of installing an umbrella stand of claim 12, wherein the bracket wings comprise a plurality fastener holes and, during the step of fastening, one or more of nails, screws and bolts, are inserted through the fastener holes and into the joist.

14. The method of installing an umbrella stand of claim 12, wherein the bracket central beam extends between the wings from terminal ends of each of the wings, whereby the bracket is U-shaped.

15. The method of installing an umbrella stand of claim 12, wherein the bracket sleeve includes a terminal protuberance extending a distance from the central beam, and further comprising the step of extending the terminal protuberance at least partially through a floor supported on the joists.

16. A flooring structure for supporting objects and persons and umbrella shaft supporting stand combination, the flooring structure comprising:

a pair of parallel joists, wherein the pair of parallel joists each include parallel side surfaces which face and are spaced from each other a distance X;

a flooring surface supported above the pair of parallel joists whereupon the objects and persons are supported; and, wherein the umbrella shaft supporting stand is secured between the pair of parallel joists, the umbrella shaft supporting stand comprising:

a bracket comprising a pair of wings and a central beam extending therebetween;

a sleeve secured to the bracket and defining an umbrella shaft receiving bore;

wherein the central beam includes an umbrella shaft receiving hole aligned with the sleeve umbrella shaft receiving bore; and, wherein each of the wings include parallel side surfaces that face away from and are spaced from each other a distance which matches the distance X, whereby the bracket is secured to the joists by locating the wings between the joists with each of the wing side surfaces located adjacent to and facing a respective joist side surface and fastening the wings to the respective adjacent joist.

17. The flooring structure and umbrella shaft supporting stand combination of claim 16, wherein the sleeve is supported beneath the flooring surface.

18. The flooring structure and umbrella shaft supporting stand combination of claim 16, wherein the flooring surface includes a flooring surface bore, wherein the flooring surface bore is aligned with the umbrella shaft receiving bore, and wherein the sleeve extends through the flooring surface bore.

* * * * *